US005854485A

United States Patent [19]

Bergmann

[11] Patent Number: 5,854,485

[45] Date of Patent: Dec. 29, 1998

[54] MS/MS TIME-OF-FLIGHT MASS-SPECTROMETER WITH COLLISION CELL

[76] Inventor: Thorald Horst Bergmann, Buchenweg 9a11 D-82441, Ohlstadt 11, Germany

[21] Appl. No.: 903,244

[22] Filed: Jul. 24, 1997

[30] Foreign Application Priority Data

Aug. 1, 1996 [DE] Germany ..... 196 31 161.6

[51] Int. Cl.[6] ..... H01J 49/40

[52] U.S. Cl. ..... 250/287

[58] Field of Search ..... 250/287, 281, 250/282

[56] References Cited

U.S. PATENT DOCUMENTS 3,621,240 11/1971 Cohen ..... 250/287
5,032,722 7/1991 Boesle et al. .
5,202,563 4/1993 Cotter et al. .

FOREIGN PATENT DOCUMENTS 0 403 965 6/1990 European Pat. Off. .

OTHER PUBLICATIONS

D.J. Beussman et al. "Tandem Reflection Time–of–Flight Mass Spectrometer Utilizing Photodissociation" Analytical Chemistry, 1995, pp. 3952–3957, vol. 67 (21) American Chemical Society.

B. Spengler et al: "Fundamental Aspects of Postsource Decay in Matrix–Assisted Laser Desorption Mass–Spectrometry: 1 Residual Gas Effects" Journal of Physical Chemistry, 1992, pp. 9678–9684 vol. 96 American Chemical Society.

T. J. Cornish et al: "A Curved field Reflection for Improved Energy Focusing of Product Ions in Time–of–Flight Mass Spectrometry" Rapid Communications in Mass Spectrometry, 1993, pp. 1037–1040, vol. 7, John Wiley & Sons.

T. J. Cornish et al: "Tandem Time–of–Flight Mass Spectrometer" Analytical Chemistry, 1993, pp. 1043–1047, vol. 65 American Chemical Society.

R. D. Beck et al: "Tandem time–of–flight mass spectrometer for cluster–surface scattering experiments" Review of Scientific Instruments of Physics.

H. Haberland et al: "Converting a reflection time–of–flight mass spectrometer into a tandem instrument" Review of Scientific Instruments, 1991, pp. 2368–2371, vol. 62, American Institute of Physics.

*Primary Examiner*—Kiet T. Nguyen

[57] ABSTRACT

In order to effect fragmentation of ions through collisions with gas-phase molecules, it is necessary to have a high gas pressure in the collision region. At the same time the residual gas pressure in the detector region of a mass-spectrometer must be kept low. This is done by arranging collision cell and detector into separately pumped vacuum regions, each region having its own pumping port, the regions only being connected via flow restrictions in the vicinity of the ion optical axis. Achieving large pressure gradients and at the same time not reducing the sensitivity of the mass spectrometer can be done by using gas flow restrictions with large cross sections. A very efficient and space saving arrangment is to place a separate chamber with the collision cell between the chamber housing the reflector and the detector and the chamber housing the ion source of the mass spectrometer.

8 Claims, 3 Drawing Sheets

MS/MS TIME-OF-FLIGHT MASS-SPECTROMETER WITH COLLISION CELL

BACKGROUND OF THE INVENTION

1. Field of the Invention

This invention relates to time-of-flight mass-spectrometers capable of preselecting ions, fragmenting these ions and then performing mass analysis of the fragmented ions. This function is generally termed as MS/MS-experiment or double mass analysis.

Time-of-flight mass-spectrometers capable of performing MS/MS-experiments usually have at least two paths of flight where ions are separated according to their mass. Always the end of one path of flight will be the starting point of the next path of flight.

Usually the first path of flight will be used to preselect some specific mass range of ions from all the ions that have been started on this path. Before or after selection this group of ions will then be modified by some specific interaction, that can be effected by a laser beam, crossing with a second particle beam or collision with molecules of some gas deliberately introduced into the interaction region.

A number of methods can be used for preselecting specified mass ranges in time-of-flight mass-spectrometers:

If the flight paths are placed orthogonally to each other, selection of a specified mass range can be effected by placing the end of the first path into the extraction optics of the second path, and switching on the extraction optics for the second flight path exactly when the desired mass range of ions is passing through the extraction optics. In this manner only the desired mass range will be deflected from its original path onto the second path.

If flight paths are colinearly arranged, then some method of pulsed deflection of the unwanted ions must be used:

a) It is possible to arrange two plates parallel to the axis of the beam. Holding these plates normally at two different potentials and just shortly switching voltages to identical potentials will only let a correspondingly short mass range of ions pass uneffected into the next flight path.

b) It is also possible to use two sets of interdigitally arranged parallel wires. Each of these two sets is connected to one power supply. Keeping both sets at the same potential as the flight path of the ions will let the ions pass uneffected. Charging these two sets to potentials symmetrically opposite to the potential of the flight path will deflect passing ions from their original path so they no longer reach the detector. Such an ion gate can deflect passing ions with comparativly low voltages and also produces electrical fields only in its very close vicinity. These features generally allow performing the mass selection with high mass resolution. Such an ion gate has been described e.g. in the publication of D. J. Beussman et al. (Analytical Chemistry, vol. 67, pages 3952–3957, 1995)

In order to extract additional information about these preselected ions their internal state will have to be modified, often by increasing their internal energy. This will cause these ions to fragment. Measuring the fragment masses will give clues to the structure of the unfragmented ions, which is one of the prominent uses of this method. These fragment masses will be determined by measuring their time-of-flight in the second flight path of the mass-spectrometer.

If it is necessary to determine more than only the mass of the fragments, it is possible to arrange a second interaction zone, filtering a mass range after or before interaction, and then using a third flight path for mass analysis of these ions that now have been modified two times.

2. Description of the Related Art

Often the internal energy of the ions is increased by colliding them with atoms of some gas, Argon, Nitrogen or Helium being the most often used gases. Very often Helium has turned out to be the best candidate.

State of the art shows two arrangements using collision gas for the production of fragment ions:

a) B. Spengler et al. (Journal of Physical Chemistry, vol. 96, pages 9678–9684, 1992) analyse the fragmentation of the molecule Cytochrom C by introducing a number of gases up to pressures of $4\times10^{-5}$ mbar into the flight path of their mass-spectrometer.

b) T. J. Cornish et al. (Rapid Communications in Mass Spectrometry, vol. 7, pages 1037–1040, 1993) analyse the fragmentation of molecules by introducing Helium or Argon with a pulsed nozzle into the collision cell of their double time-of-flight mass-spectrometer. The collision cell is located between the two symmetrically arranged flight paths of their mass-spectrometer.

The simplest method of fragmentation has been employed by B. Spengler et al. by introducing the collision gas directly into the flight path of the mass-spectrometer. This is the cheapest method for fragmenting ions and can also very easily be set up. The main disadvantage of this method is, that it usually will be necessary to introduce large amounts of collision gas into the mass-spectrometer to get sufficient fragmentation of the ions. Especially Helium, which is a favorite candidate as collision gas will have to be introduced in such high amounts that electrical discharges can occur in the vacuum housing of the mass-spectrometer endangering delicate components such as the detector.

The MCP or multichannel plates, often used in the detectors of time-of-flight systems, are usually specified to a maximum background pressure of $10^{-1}$ mBar. Electrical discharges will start at background pressures above $10^{-}$mBar.

T. J. Cornish et al. have found a method to effect sufficient fragmentation of their ions using Helium as a collision gas. They use a pulsed nozzle to introduce Helium at high density into their collision cell. They can further increase the gas pressure at the collision site by attaching a needle extension to their nozzle. (Analytical Chemistry, vol. 65, pages 1043–1047, 1993).

By waiting long enough after a Helium pulse they prevent a rising of the background gas pressure to levels that can endanger components of their mass-spectrometer. Thus, to prevent dangerously high pressures in the vacuum chamber the nozzle must be pulsed at a low repetition rate. Using such a low repetition rate will correspondingly reduce the sensitivity of the mass-spectrometer. Also a pulsed nozzle usually has a short lifetime necessitating frequent changes of this component.

SUMMARY OF THE INVENTION

Thus it is an object of the invention to provide an MS/MS-time-of-flight mass-spectrometer using a convenient design for allowing a high pressure in the gas collision cell sufficient for effective fragmentation of molecules without reducing the sensitivity of the instrument. It is a specific object of the invention to allow high pressures in the gas collision cell at the same time preventing electrical discharges on components in the mass-spectrometer that carry high voltages.

The characterizing features of the invention are given in claim 1.

In accordance with the invention a further vacuum chamber, called collision chamber, will be arranged before the vacuum chamber containing the reflector. This collision chamber will contain the collision cell. By placing flow restrictions between collision chamber and reflector chamber and by pumping each chamber separately it is possible to achieve a very high pressure in the collision cell, while at the same time the pressure in the chamber containing the reflector will only rise by very small amounts.

The collision chamber and the reflector chamber will be arranged in separate vacuum regions, each having its respective pumping port. These vacuum regions are only connected via openings or channels whose conductivity is lower than the pumping capacity of the pump at the region with the lower pressure. The openings of channels between the chambers are called flow restrictions.

The most basic implementation of a flow restriction is an opening or aperture of some cross section in a plane separating regions of different gas pressure. However, tubes or constructions with tube character have a significantly lower conductivity for gases than openings in a plane and will be often preferred. Usually it is best to choose the size of an opening just large enough to let all ions of interest pass through. Thus a maximum sensitivity of the mass-spectrometer is achieved while simultaneously keeping the conductivity of the flow restriction as low as possible.

It is also possible to combine collision chamber and reflector chamber in one vacuum chamber creating two separately pumped vacuum regions by placing some part or plane into the vacuum chamber which inhibits the flow of gas from one region to the other, and also by providing a pumping port for each of these regions.

By placing the collision cell in close vicinity to the extraction volume of the time-of-flight mass-spectrometer it is possible to choose small cross sections for the flow restrictions at the same time passing beams of large divergence through the collision cell into the mass-spectrometer. Ion beams of large divergence will transport a larger number of ions, which effects an increased sensitivity of the mass-spectrometer.

Advantageous implementations of the invention are given in the sub-claims. According to the subclaims, highly advantageous embodiments of the invention use components of the MS/MS-time-of-flight mass-spectrometer as flow restrictions between the regions of different pressure, thus achieving maximum pressure gradients between the reflector- or ionsource chamber and the collision chamber.

DESCRIPTION OF THE PREFERRED EMBODIMENTS

Some implementation examples of the invention will now be described in conjunction with the drawings.

Figure 1:
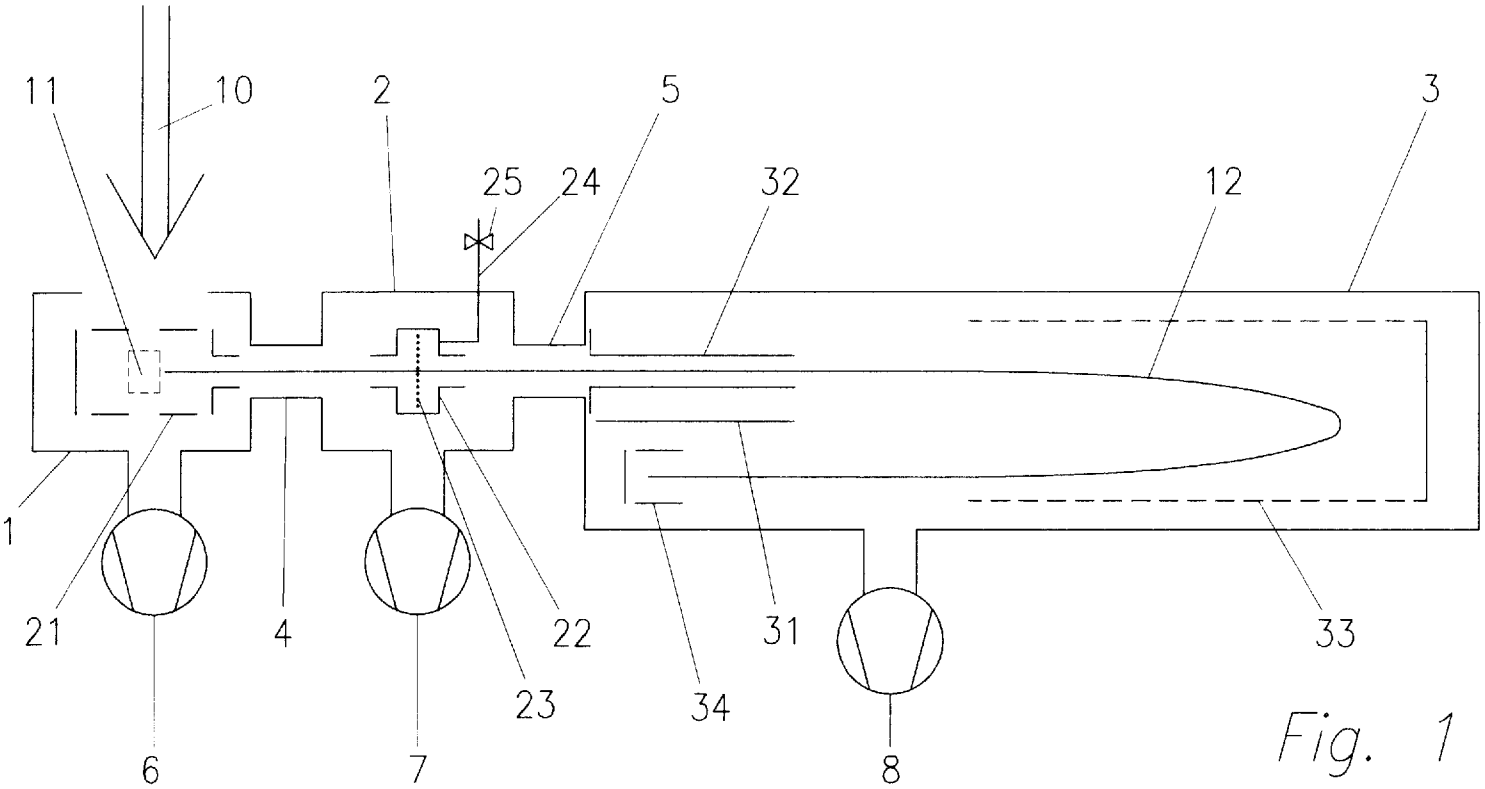
FIG. 1 shows an embodiment of the invention.

FIG. 1 shows a first embodiment of the invention. The ion source(21) with its extraction volume(11) is shown within the ion source chamber(1). The ion source chamber is pumped by a pump(6) creating a base pressure preferrably below $10^{-6}$ mBar. At start-time of the mass analysis, those ions of the analyte beam(10) which are at that moment in the extraction volume of the ion source will be accelerated on paths(12) to the detector(34) of the mass spectrometer.

The collision chamber(2) is arranged closely behind the ion source chamber. These two chambers are connected via a tube(4) which serves also the purpose of a flow restriction. The collision cell(22) is located in the collision chamber. The collision gas can be fed to the collision cell through a line(24) and regulated by a valve(25). The collision chamber is pumped by a pump(7) that can preferrably achieve a base pressure below $10^{-5}$ mBar. The ion selector(23) is located within the collision cell.

Tubing(5) connects the reflector chamber(3). To prevent stray electrical fields from deflecting the ions, the paths must be shielded, such as a metal sheet(31) or by a tubing(32) containing the ion paths. This tubing can also serve the purpose of flow restriction between collision chamber and reflector chamber. The cross section of this tubing can be used to adjust its conductivity, preferrably to reduce it, as shown in FIG. 1. The reflector(33) will turn around the direction of flight for the ions so they can hit the detector (34), which is located in close proximity to the entrance tube to the reflector chamber. The reflector chamber is pumped by a pump(8) preferrably achieving a base pressure below $10^{-6}$ mBar.

This embodiment of the invention protects the detector and reflector from unduly high background gas pressures, the multichannel plates of the detector being the most sensitive component in this respect where pressures higher than $10^{-4}$ mBar will cause problems.

This embodiment also shows the ion source of the mass-spectrometer in a separate chamber which is only connected to the collision chamber via some flow restriction. Pressures higher than $10^{-3}$ mBar can lead to electrical discharge phenomena on the electrodes of the ion source. Thus it is advantageous to arrange separate pumping ports for ion source chamber and collision chamber, placing a flow restriction between the two. This will restrict the rise of gas pressure when collision gas is fed to the collision cell.

Figure 2:
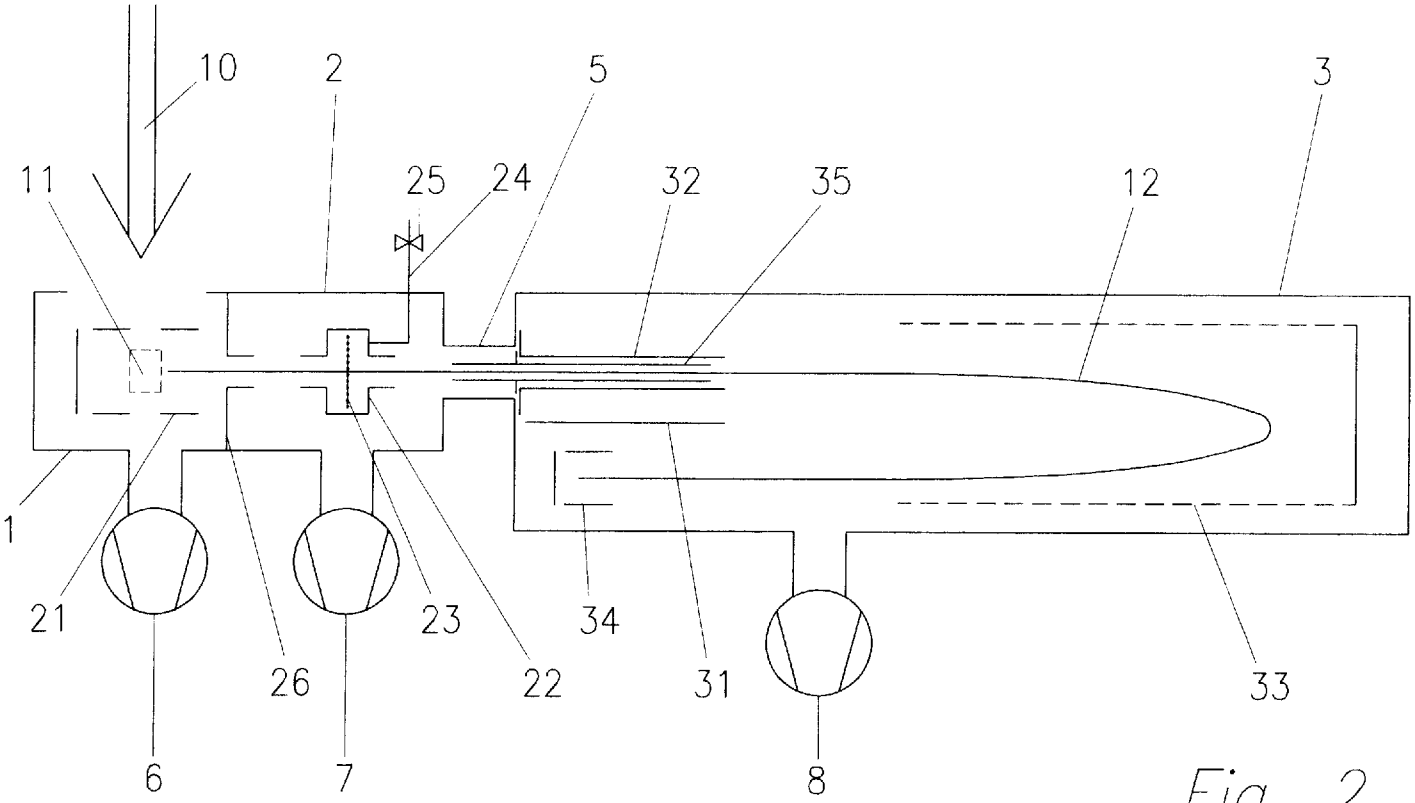
FIG. 2 shows another embodiment of the invention.

FIG. 2 shows a second embodiment of the invention. Here the ion source and the collision chamber have been integrated into a single vacuum chamber which is split into two separately pumped vacuum regions by a plate(26) containing an aperture for the ion beam. This plate can also carry a tubing which will result in a flow restriction with lower conductivity.

Within the connecting tube(5) between the collision chamber(2) and the reflector chamber(3) and the entrance tube(32) to the reflector chamber another tubing(35) of smaller diameter is arranged which further reduces the gas conductivity between the collision chamber and the reflector chamber. Using a very long tubing here both within the connecting tube(5) and the entrance tube(32) will cause another reduction in gas conductivity.

Figure 3:
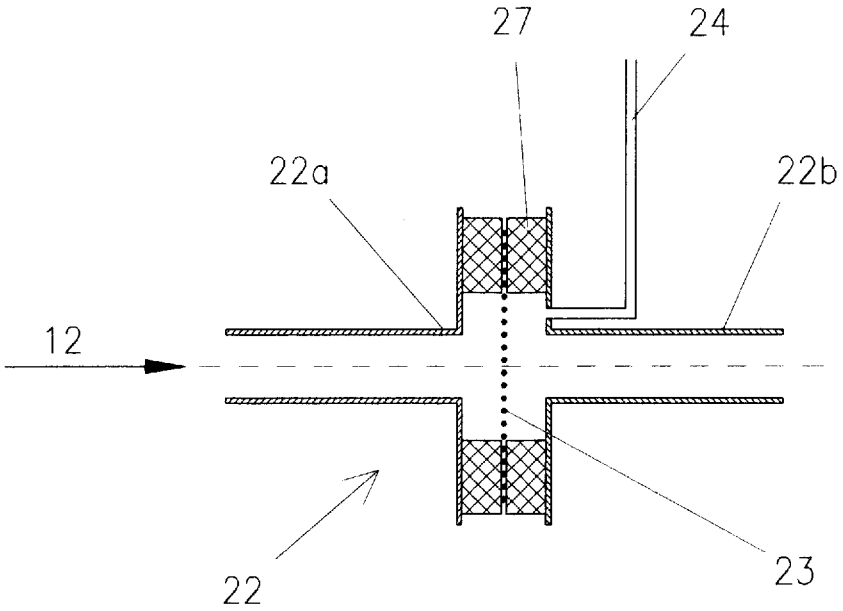
FIG. 3 shows an embodiment of the collision cell with integrated ion selector.

FIG. 3 shows an embodiment of an ion selector(23) integrated into a collision cell(22). The ion selector is shown here as a parallel wire ion gate and is carried by ceramic rings(27). The collision cell itself is made from two halves (22*a*, 22*b*), that can be pressed or glued together by any known method. Since both halves of the collision cell can be fabricated from metal, the complete unit can easily be mounted within the collision chamber. The collision gas is introduced via tubing(24) which enters the collision cell in close proximity to the ion selector. The wires of the ion selector shown in this embodiment are located in a plane orthogonal to the ion optical axis and split the collision cell into two symmetrical half-parts. By introducing the collision gas close to the center of the collision cell, a maximum pressure within the collision cell can be achieved while simultaneously creating a minimal gas load of within the rest of the collision chamber and the pump that must carry away this gas.

what is claimed is:

1. An MS/MS-time-of-flight mass-spectrometer comprising an ion source(21), a reflector(33), a detector(34), and a collision cell(22), said collision cell having a port of entry for some collision gas causing the decomposition of primary ions to fragment ions, characterized by said mass-spectrometer being subdivided into regions of different gas pressure, each of these regions containing its own port for connection of a pump(6,7,8), said regions of different gas pressure being connected via flow restrictions(4,5,32,35), one of said regions being the reflector chamber(3) containing the reflector(33), another one of these regions being the collision chamber (2) containing the collision cell(22), said collision chamber(2) being positioned with respect of the ion paths in front of the reflector chamber(3).

2. An MS/MS-time-of-flight mass-spectrometer according to claim 1 characterized by an ion source(21) that is arranged in an ion source chamber(1) and a collision cell(22) that is arranged in a collision chamber(2), said two regions containing each its own port for connection of a pump(6,7), said two regions only being connected via flow restrictions (4), such that the ion source chamber(1) has a lower gas pressure than the collision chamber(2) when collision gas is fed to the collision cell(22).

3. An MS/MS-time-of-flight mass-spectrometer according to claim 1, characterized by a reflector(33) and a detector(34) that are contained within the same vacuum region.

4. An MS/MS-time-of-flight mass-spectrometer according to claim 1, characterized by a tube(5) connecting the collision chamber(2) to the reflector chamber(3) said tube at least partially serving the purpose of a flow restriction between said chambers.

5. An MS/MS-time-of-flight mass-spectrometer according to claim 1, characterized by an entrance tube(32) to the reflector chamber(3) that augments the connecting tube(5) between the collision chamber(2) and the reflector chamber (3), the combination of both tubes having a lower gas conductivity than the conductivity of one of the tubes alone.

6. An MS/MS-time-of-flight mass-spectrometer according to claim 5, characterized by an additional tubular flow restriction(35) of smaller diameter than either the entrance tube(32) to the reflector chamber(3) or the tube(5) connecting the collision chamber(2) to the reflector chamber(3), said additional flow restriction being arranged within one or both of the entrance tube(32) or the connecting tube(5).

7. An MS/MS-time-of-flight mass-spectrometer according to claim 1, characterized by an ion source(21) and a collision cell(22) both arranged into a single vacuum chamber, said chamber being subdivided by some plane(26) containing an opening as a flow restriction into two separately pumped regions(1,2), each region containing its own port for connection of a pump(6,7), one of these regions containing the ion source, the other containing the collision cell.

8. An MS/MS-time-of-flight mass-spectrometer according to claim 7, characterized by an ion source(21) that encompasses a number of electrodes, one of these electrodes simultaneously forming at least part of the plane(26) separating the ion source chamber from the collision chamber, said electrode containing an opening connecting the two chambers with a flow restriction.

* * * * *